US005562184A

United States Patent [19]

Yung-Ho

[11] Patent Number: 5,562,184

[45] Date of Patent: Oct. 8, 1996

[54] APPARATUS FOR HIGH-RISE ESCAPE SLOW DESCENDING TUBE

[76] Inventor: Hsu Yung-Ho, No. 261, Yung Ell St., Yung-Kang City, Tainan Hsien, Taiwan

[21] Appl. No.: 500,771

[22] Filed: Jul. 11, 1995

[51] Int. Cl.[6] ..... B66B 7/00

[52] U.S. Cl. ..... 187/414; 182/48

[58] Field of Search ..... 187/414; 182/48, 182/49, 63, 70, 76, 82, 230

[56] References Cited

U.S. PATENT DOCUMENTS

| | | | |
|---|---|---|---|
| 3,580,358 | 5/1971 | Yamamoto | 182/48 |
| 4,582,166 | 4/1986 | Baker | 182/48 |
| 5,060,753 | 10/1991 | Hopkins | 182/48 |

*Primary Examiner*—Kenneth Noland

*Attorney, Agent, or Firm*—Morton J. Rosenberg; David I. Klein

[57] ABSTRACT

A high-rise escaping slow descending tube, premounted to a frame to the building with both inner and outer sides each pivoted to a cover plate and cylindrical base wherein a sliding tube is placed with one end fixed, a cylindrical cover is pivoted to the bottom end of the cylindrical base. The sliding tube at its peripheral is connected with a soft tube portion to multiple axial supporting bands, and alternatively arranged radial clamps and tension fasteners. A web is connected to the supporting band extended from the bottom end of the tube portion; whereby, when cover plate is opened, the cylindrical base flips outward in flush and the sliding tube falls off to provide one to escape through the frame and glide down inside the tube portion at slow speed buffered by clamps and tension fasteners.

4 Claims, 4 Drawing Sheets

APPARATUS FOR HIGH-RISE ESCAPE SLOW DESCENDING TUBE

BACKGROUND OF THE INVENTION

1. Field of the Invention

This invention relates to a an apparatus, and more particularly to a sliding tube, provided at a proper location of a high-rise, formed in its full length with alternatively arranged clamps and tension fasteners allowing suspension, descending and extension for a proper length so that one may descend slowly and vertically inside the tube to the safe place on the ground.

2. Background of Prior Art

Whereas elevators, stairs and exits are usually incorporated in the planning for the construction of urban buildings to provide multiple accesses with additional escape devices made available at each floor in case of an act of God or other hazards when the elevator fails or other passages are blocked. Generally, said additional escape devices include fire ladder, escape slow descender and escape sliding tube, within, 1. Said fire ladder usually mounted in the open space such as the balcony and is made foldable for space saving when not in use. Its operation however always discourages the handicapped, the aged and the children who are slow in response in case of a fire, earthquake or other hazards. The comparatively lengthy time taken to spread up said ladder affects the escape in case of an emergency;
2. The escape slow destender mainly comprising a movable suspension rope connected to a slow descender which is fixed to the building. In case of an emergency, one by holding onto said rope which is harnessed to said slow descender may slowly descend taking advantage of one's weight down to the ground; however, in practice, this device is found with three major defects, respectively are:
   A. The fear to be suspended and to descend down from the high altitude frustrates the attempt to escape by the people even under hazardous circumstances;
   B. The user must be very familiar with the operation of said device and saving such knowledge will serious affect the chance to escape in case of an emergency; and
   C. It allows to be used only by one person each time and that is certainly insufficient for a desperate situation; and
3. The escape sliding tube usually operates in conjunction with the elevating gear such as a scaling ladder from a fire engine. Said tube is made to attain a proper sliding angle to slow down descending speed. However, without outside help, said escape sliding tube is actually useless; furthermore, the required sliding angle of the tube and the limited mounting space also discourage the option of escape sliding tube.

SUMMARY OF THE INVENTION

It is the primary object of the present invention to provide an escape tube allowing people slide down inside it. Said tube of proper length connected to a fixed frame which may be pre-mounted at a balcony, window sill or similar place, is formed by sections with each section comprising alternatively arranged clamps and fasteners in sequence to allow one vertically slide down inside it.

Both inside and outside of said fixed frame is pivoted with a cover plate and a cylindrical base. Said cylindrical base accommodates the folded sliding tube. Both of cylindrical base and sliding tube are connected to each other at one end. One mobile cover is pivoted to the open end at the bottom of said cylindrical base. Said sliding tube, comprising a soft tube in proper diameter and length connected at its peripheral a plurality axial supporting bands, and alternatively arranged radial clamps and tension fasterners in shape of a reversed cone, is connected to a web at the supporting bands extended from the bottom end of said sliding tube, whereby the fixed frame is premounted to a building with the cover plate inside the building and cover facing outward. In use, the cover is opened and the cylindrical base flapped over outward in flush, and the cover at the bottom end of the cylindrical base is also opened to allow the built-in sliding tube fall by its own weight, allowing one slide through the tube in descending speed buffered by clamps and tension fasterners inside said tube.

DETAILED DESCRIPTION OF THE PREFERRED EMBODIMENT

Figure 1:
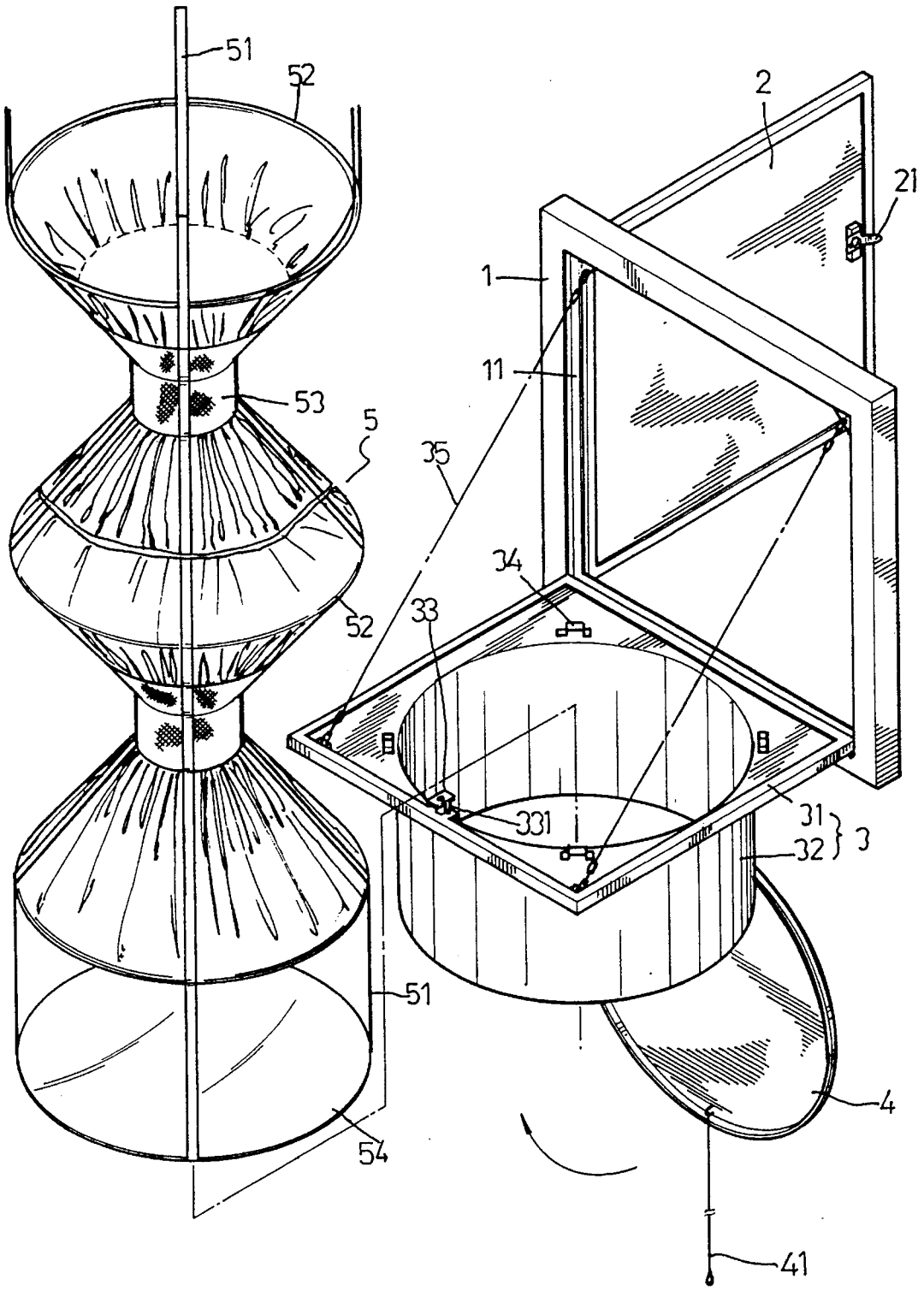
FIG. 1 is an exploded view of the present invention.

FIG. 1 illustrates a fixed flame(1), cover plate(2), cylindrical base(3) and cover(4), and a sliding tube(5) connected to said frame(1).

A frame wall(11) along both inner and outer peripherals in said fixed flame(1) is formed to receive the closed cover plate(2) and hold cylindrical base(3) in position.

One side of said cover plate(2) is pivoted to said fixed frame(1) with a push button (21) provided on top to lock onto said frame (1).

Said cylindrical base(3) is connected to a hollow cylinder outside of a plate(31) corresponding to said fixed frame(1), and one end of the inner side to said plate(31) is provided with a knob(33) locked on to the frame wall(11) of said frame(1), one side of said knob(33) extends to form a hooking lever(331) with branches, multiple connection tabs(34) are provided at the circumference relative to said cylinder(32). One side of said plate(31) is pivoted to the lower side of said frame(1) while the other side of said plate(31) is connected with chain rope(35) (connection rod or curved arm)to the upper side of said fixed frame(1).

The dish-shape cover(4) corresponding to the outer diameter of cylinder (32) at the cylindrical base(3) has its one end pivoted to said cylinder(32) and the other end connected with a rope(41) to hook onto the lever(331) of said knob(33) upon closing up said cylinder.

The sliding tube(5) relates to a soft tube in proper length to allow one slide through. Multiple axial supporting bands(51) are provided at both inner and outer circumferences of said tube(5) and radial clamps(52) are placed at proper space in said tube to appropriately expand said tube. One tension fastener(53) with wider upper part and narrow lower part is encapped onto the outer circumference of the tube(5) between the pair of abutted clamps to make said section of the tube forming a funnel to facilitate people passing through while said supporting bands(51) are extended a proper length from the bottom end of the tube(5) to connect a web(54).

By means of the aforesaid members, the sliding tube(5) penetrates through the cylinder(32) of the cylindrical base(3) so that the upper edge of the sliding tube(5) is fixed to the circumference of said cylinder(32) of the tube. Supporting bands(51) at the top of said sliding tube(5) are connected to those tabs(34) on the plate(31) allowing cylindrical base(3) and sliding tube(5) be fixed and interconnected to each other; furthermore, the folded sliding tube(5) can be accommodated within said cylinder(32) and fixed at its bottom by hooking the rope(41) provided at one side of cover(4) pivoted to the bottom of said cylinder(32) when closed up, to the lever(331) of the knob(33) on the cylindrical base(3), that is, said sliding tube(5) is retreated in position within said cylindrical base(3).

Figure 2:
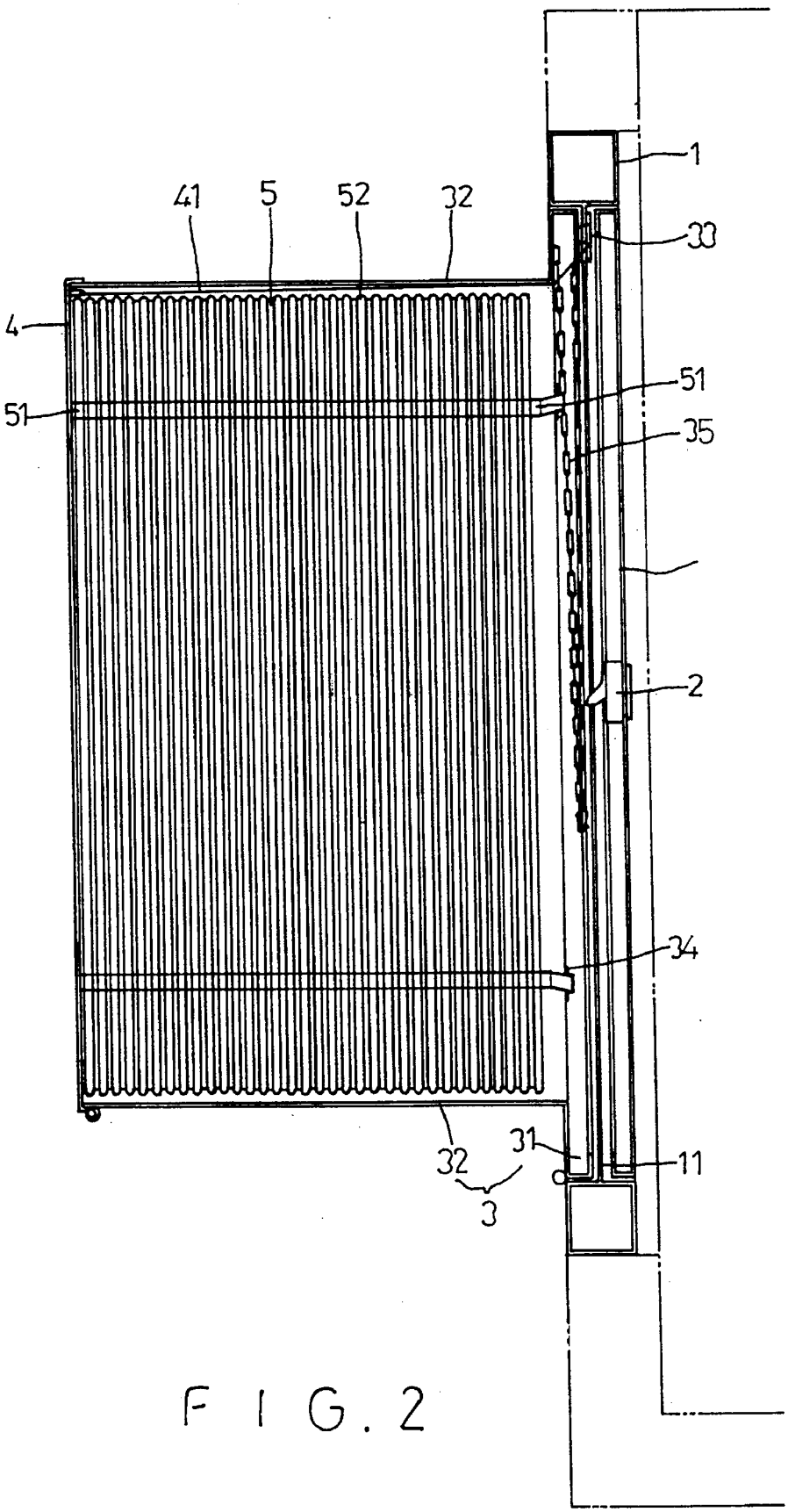
FIG. 2 is a side view of the embodiment of the present invention.
Figure 3:
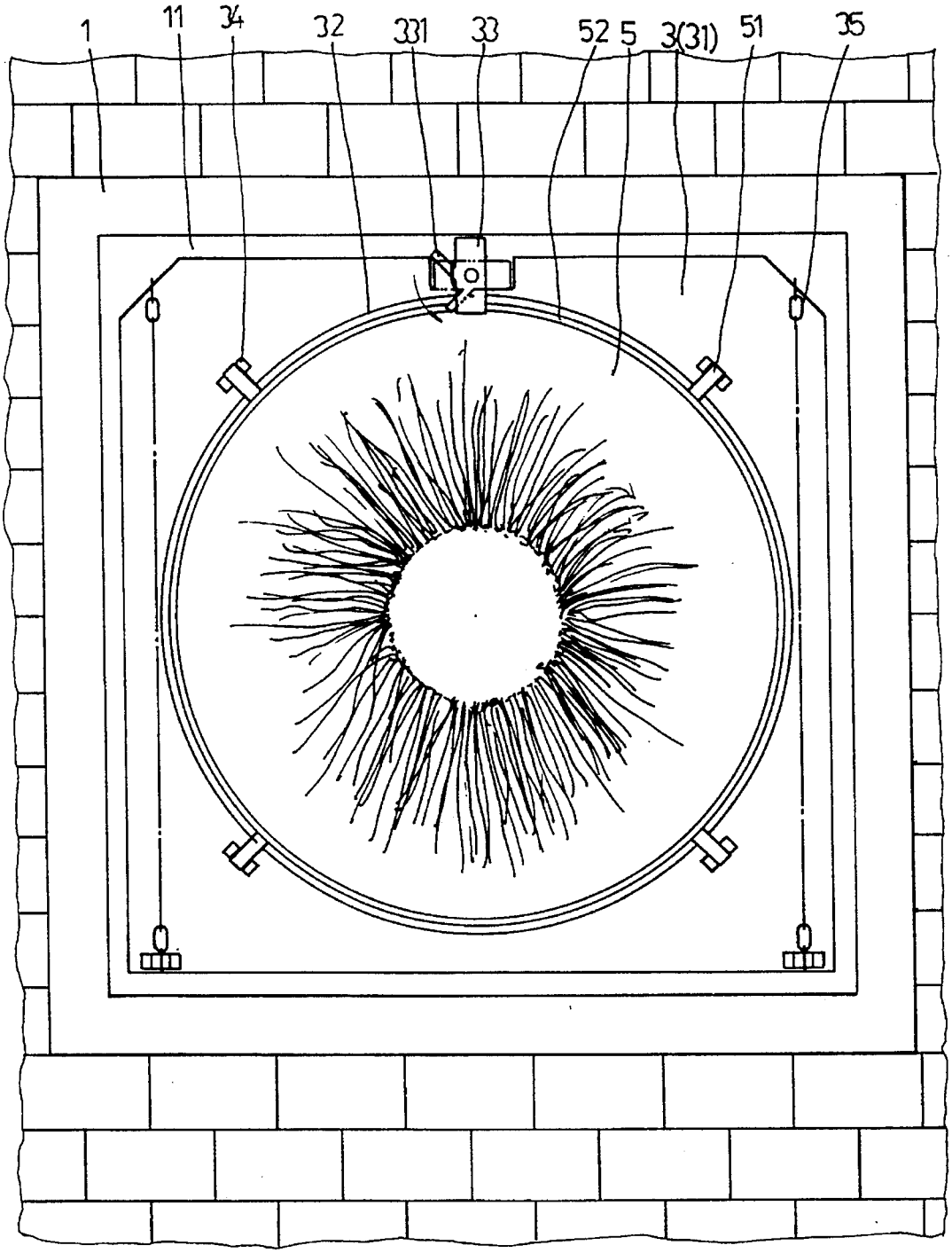
FIG. 3 is a rear view of the embodiment of the present invention.

As illustrated in FIGS. 2 and 3, there are shown the preferred embodiment of the present invention when applied to a building, more particularly to the general balcony for example(the present invention may be mounted at the same time with the construction of balcony in conjunction with that of steel window barrier, mid window sill). within, the frame(1) is inserted into the balcony with the cover(2) facing any side of the interior while the cylindrical base(3) at one side facing outdoor allowing flip up to make the cylinder(32) of the cylinder be placed in a horizontal plane. The plate(31) is placed into the frame(1) so that the knob(33) is snapped to the frame wall(11). Said cover plate(2) may also close up against said frame(1), and lock up to the frame(1) by the push button(21) provided on said cover plate(2).

Figure 4:
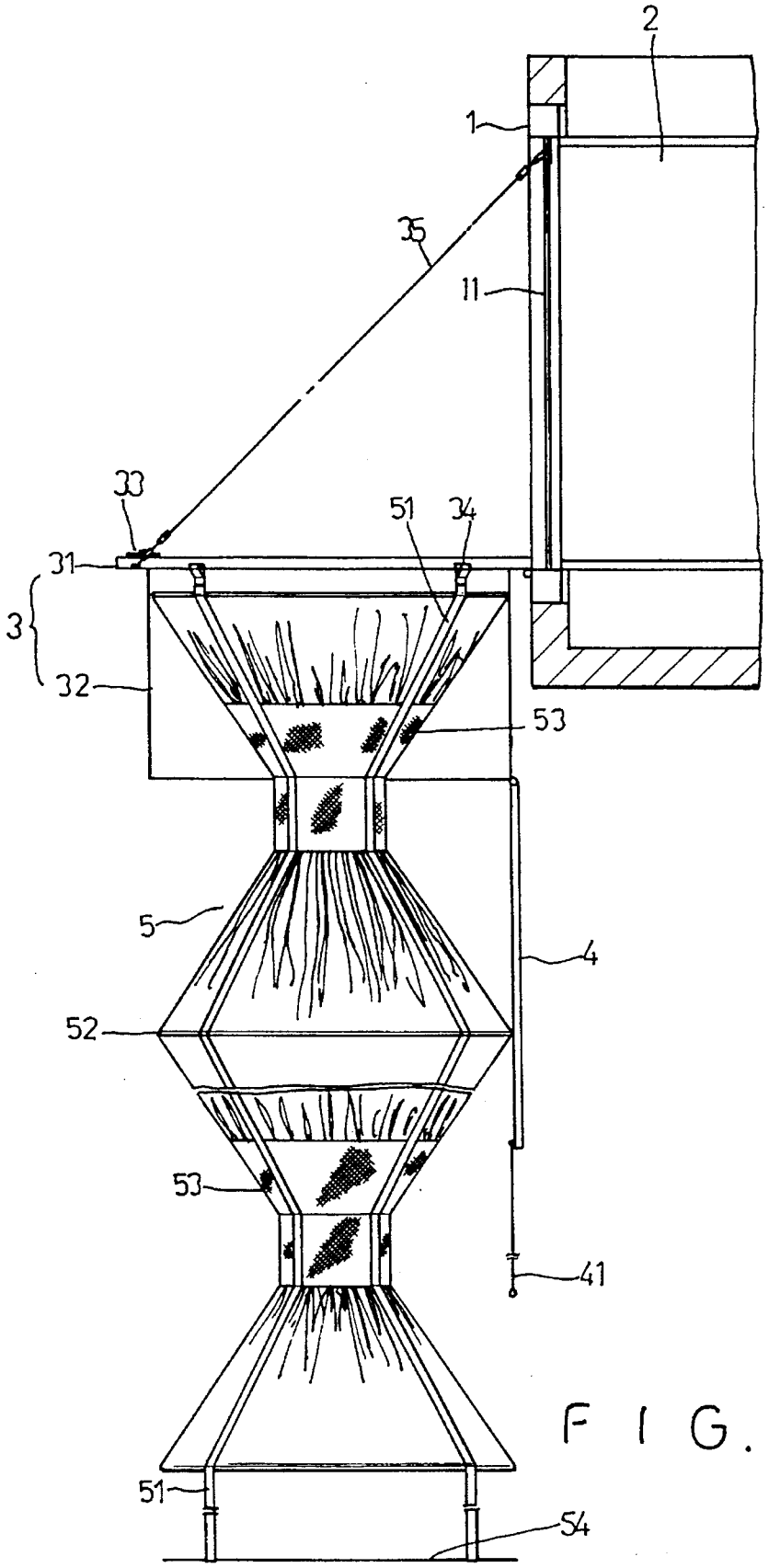
FIG. 4 is a view illustrating the operation of the embodiment of the present invention.

When in operation as illustrated in FIG. 4, the push button (21) on the cover plate(2) is released to open up said plate(2), and the knob(33) on the plate (31) of cylindrical base(3) is turned to cause said base(3) to disengage from the frame(1) and flip over to be pulled and supported by the chain rope(35) for staying in position.

The cylinder(32) is facing down at right angle, the hooking lever(331) to said knob(33) is also facing down to cause the rope(41) to fall off automatically(refer also to FIG. 3) and the cylindrical cover(4) at the bottom of said cylinder(32) flips over to open up to allow the sliding tube(5) suspend downward by its own gravity. One then may pass through the flame(l) to enter said sliging tube(5) within the cylindrical base(3) and glide down along the alternatively arranged clamps(52) and cone-shape fasteners(53) to buffer the descending speed by stage and by expanding said sliding tube(5) due to the binding force offered by said fasteners(53). At the end of the sliding tube(5), there is provided with a web to receive the one escaping through said tube and to buffer one's descending force without hurting said person who then will exit between supporting bands(51) extended from the end of said sliding tube(5). The design of funnel-shape allows the one escaping through the sliding tube be fully and comfortably received by the sectional arrangement of funnel-shape fasteners(53) which offers the gliding down by section, buffered descending speed and easy gliding ride during the escape to reduce the suffocating effects may be accoutered with in the process of falling down. The present invention operates safely and effectively to the building disregarding the timber of floor.

Furthermore, the same advantages can be also attained if tension fasteners are arranged by section with a proper spacing on the main portion of the sliding tube(5) having sectional and shortened flexible portions. That is, the embodiment described in the preceding paragraph could be the most summary form of the present invention.

Special fire-proof material can be used to wrap up said sliding tube(5) to offer additional fire protection for the one escaping through said tube(5).

I claim:

1. A high-rise slow descending tube comprising a fixed frame, cover plate, cylindrical base and cylindrical cover and a sliding tube which can be folded to store inside and connected to the cylindrical base, within:

said fixed frame can be pre-mounted to a building and connected to a soft sliding tube in proper length, multiple axial supporting bands are provided at both inner and outer peripherals of said tube, and radial clamps are placed at equal and proper spacing in said tube, a funnel-shape tension fastener with wider upper part and narrower lower part is encapped to the peripheral between each pair of said abutted clamps, whereby the supporting band at the upper end and the tube is fixed and connected to the fixed frame while the lower end extends the supporting band to connect a web;

the sliding tube is fixed to the building by means of said fixed frame and indicates a vertical suspension to allow one passing through the fixed frame to enter the sliding tube, then descending down at slow speed by section as offered by the arrangement of clamps and tension fasteners.

2. The slow descending tube as claim 1, within, said cover plate and said cylindrical base are separately pivoted to inner and outer sides of the frame, the cylindrical base will flip down to maintain a positioning support function to the frame with a connection element, namely, chain, rope, linkage, or cubed ann, a knob is provided on the cylindrical base to lock up upon closing up the frame, a hooking lever extends from said knob is pivoted to said cylindrical cover at one side to the bottom end of said cylindrical base while the other end of said cylindrical cover is connected with a rope to hook onto the hooking lever of said knob.

3. The slow descending tube as claim 1, within, said tension fasteners are provided at equal and proper spacing on the tube to attain the same effects of slow descending by section.

4. The slow descending tube as claim 1, within, the outer layer of said sliding tube may be wrapped up with fire-proof sleeve to offer additional fire protection.

* * * * *